US008152375B2

(12) United States Patent
Edlinger

(10) Patent No.: US 8,152,375 B2
(45) Date of Patent: Apr. 10, 2012

(54) BAG AND METHOD FOR EMPTYING A BAG

(75) Inventor: Ernst Edlinger, Zeltweg (AT)

(73) Assignee: Mondi AG, Wien (AT)

( * ) Notice: Subject to any disclaimer, the term of this patent is extended or adjusted under 35 U.S.C. 154(b) by 297 days.

(21) Appl. No.: 12/488,848

(22) Filed: Jun. 22, 2009

(65) Prior Publication Data

US 2009/0324144 A1 Dec. 31, 2009

(30) Foreign Application Priority Data

Jun. 23, 2008 (DE) ..... 10 2008 029 507

(51) Int. Cl.
*B65D 33/00* (2006.01)
*B65D 33/16* (2006.01)
*B65D 30/12* (2006.01)

(52) U.S. Cl. ..... 383/200; 383/203; 383/205; 383/211; 383/99; 383/125; 383/906

(58) Field of Classification Search ..... 383/98, 383/99, 125, 126, 200, 203, 205, 210, 211, 383/78, 81, 47, 48, 52, 53, 54, 67, 906; 229/219, 229/216, 212, 87.05
See application file for complete search history.

(56) References Cited

U.S. PATENT DOCUMENTS 2,203,924 A * 6/1940 Pletscher ..... 383/206
2,583,856 A * 1/1952 Klein ..... 229/219
2,998,911 A * 9/1961 Hahn et al. ..... 383/205
3,081,930 A * 3/1963 Owens ..... 383/205
3,591,072 A * 7/1971 Sannino ..... 383/54
3,648,922 A * 3/1972 Gebo ..... 383/205
5,823,685 A 10/1998 Garlichs
7,285,082 B1 10/2007 Walker

FOREIGN PATENT DOCUMENTS

DE 3941300 6/1991
DE 4010822 A1 * 10/1991
EP 1033311 9/2000
JP 61 153731 9/1986

* cited by examiner

*Primary Examiner* — Jes F Pascua
(74) *Attorney, Agent, or Firm* — Whitham Curtis Christofferson & Cook, PC

(57) ABSTRACT

To empty a bag which has at least one cross bottom (4) which is covered with a bottom cover sheet (18) and which has an essentially rectangular shape and is glued together out of corner tucks (11) angled from narrow sidewalls via folding lines and out of bottom flaps (12) angled from wide sidewalls via folding lines (13, 14), there is provision, according to the invention, whereby the bottom cover sheet (18) is drawn off, starting from a narrow sidewall, from the respective corner tuck (11) and from part of the adjoining bottom flaps (12), whereby the bottom flaps (12) are torn on the far side of the corner tuck, transversely with respect to their free edges, as far as the adjoining wide sidewall, in order to separate a part (12') of the bottom flaps (12), and whereby the separated parts (12') of the bottom flaps (12), together with the corner tuck (11), are bent, by being folded up about the folding lines (13, 14, 23), into a pour-out channel (24), via which the emptying of the bag contents takes place.

11 Claims, 5 Drawing Sheets

BAG AND METHOD FOR EMPTYING A BAG

FIELD OF INVENTION

The invention relates to a method for emptying a bag which has at least one cross bottom which is covered with a bottom cover sheet and which has an essentially rectangular shape and is glued together out of corner tucks angled from narrow sidewalls via folding lines and out of bottom flaps angled from wide sidewalls via folding lines.

The invention relates, furthermore, to a bag formed by at least one material ply which is formed into a closed tube which can be shaped into an essentially rectangular cross section with narrow sidewalls and wide sidewalls and which at a first end has a closable filling orifice and at least one of its ends is glued together into a cross bottom with corner tucks angled from the narrow sidewalls and with bottom flaps angled from the wide sidewalls and is covered with a bottom cover sheet covering the cross bottom.

BACKGROUND

Forming a bag from a tubular material by folding at least one cross bottom is a conventional method. In this case, a cross bottom may be provided on both ends of the bag tube, in particular a valve also being insertable into one of the cross bottoms, so that a valve bag capable of being filled by a bag filling machine via a filling connection piece is formed. However, it is also possible, for example, to form a bag bottom on only one side of the tube and to fill the bag open at the top and after filling to close it, for example by stitching, gluing, closing by means of adhesive or touch-and-close fastening strips etc.

A filled bag should be closed so as to be as leaktight as possible, in order, where dusty materials are concerned, to prevent dust from escaping from the material. When the filled bag has been transported to a destination where the introduced product is to be used, the bag is torn open so that the introduced material can be poured out or otherwise extracted. Since the bag bottom consists of numerous plies which have been glued to one another, the bag bottom is not appropriate for the tearing-open operation. Tearing open the bag underneath the bottom takes place in the tubular material of the casing wall of the bag. If tearing open is carried out freely, it often happens that the tear made does not run transversely with respect to the longitudinal axis of the bag in the desired way, but, instead, occurs obliquely with a component in the axial direction. In this case, it may happen that the tear continues, level with the product introduced in the bag, so that, even when the bag is being torn open, an undesirable escape of product from the bag occurs and the area where the bag is torn open is contaminated. One remedy may be to open the bag by means of a sharp cutting instrument in the form of a scissor or a knife. This has the disadvantage of the resulting time required for opening the bag and the fact that an extra aid provided, which has to be kept operational, is always needed for opening the bag.

SUMMARY

The problem on which the present invention is based, therefore, is to make it possible to empty a bag without aids and without the risk of scarcely avoidable contaminations.

This object is achieved, according to the invention, by means of a method of the type initially mentioned, in that the bottom cover sheet is drawn off, starting from a narrow sidewall, from the respective corner tuck and from a part of the adjoining bottom flaps, in that the bottom flaps are torn on the far side of the corner tuck, transversely with respect to their free edges, as far as the adjoining wide sidewall, in order to separate part of the bottom flaps, and in that the separated parts of the bottom flaps, together with the corner tuck, are bent, by being folded up about the folding lines, into a pour-out channel, via which the emptying of the bag contents takes place.

According the invention, therefore, there is provision for the tearing open of the bag for the purpose of emptying it to take place in the bottom region, in that the bottom cover sheet is drawn off at least partially from the mutually overlapping bottom flaps. This drawing off may be assisted by means of a suitable gluing of the bottom cover sheet and/or by providing the bottom cover sheet with a draw-off aid, for example in the form of a tear-open strip. When the bottom flaps are exposed in their mutually overlapping region, the tearing of the bottom flaps perpendicularly with respect to the longitudinal and tear-open direction of the bottom cover sheet takes place, specifically as far as the adjoining wide sidewall. As a result, part of the two bottom flaps is exposed and can be swung up about the folding line existing toward the wide sidewall. If appropriate, in this case, an existing adhesive bond between the bottom flap and the associated corner tuck is released. This opening operation can therefore be assisted in that this adhesive bond is implemented only on a small area. With the bottom flaps being folded up, the corner tuck not glued to the bottom flaps on the inside can also be folded up. This gives rise to a coherent pour-out orifice delimited by three sides (two bottom flaps and a corner tuck). Since the corner tuck has a central folding line which arises from the bag tube being laid flat for transport before filling, it is readily possible to utilize the folding line still present in order to fold the corner tuck in a V-shaped manner and produce a triangular pour-out channel.

The method according to the invention thus makes it possible to form a pour-out orifice in the region of the bottom, the tearing-open operation taking place during the release of the bottom cover sheet and during the tearing of the bottom flaps in the bottom region and therefore being uncritical for the product introduced in the bag. Any tears running obliquely remain in the bottom region and do not cause introduced product to emerge from the bag in an unwanted way. The pour-out channel designed according to the invention makes it possible to pour the product out of the bag reliably, the pour-out channel not being delimited by torn bag walls, but by utilizing the cut edges made during the production of the bag.

To make it easier to tear the bottom flaps, these may be provided with tear-open aids. What are suitable in particular, are short incisions which do not exceed the overlap region of the two bottom flaps and ensure a defined start of the tearing line in the bottom flap, said tearing line extending as far as the adjacent wide sidewall, and which considerably limit the spread in the direction of the tearing line.

To achieve the abovementioned object, furthermore, a bag of the type initially mentioned is characterized according to the invention, in that the bottom cover sheet is designed to be capable of being drawn off, starting from a narrow sidewall, at least over a partial region, from the cross bottom beyond the respective corner tuck, and in that at least one of the bottom flaps has, in a region no longer lying on the corner tuck, at least one tear-open aid for separating a part of the bottom flaps, so that the separated parts of the bottom flaps, together with the outwardly drawn corner tuck, form a pour-out channel.

The draw-off capability of the bottom cover sheet may be assisted by means of a suitable adhesive bond of the bottom cover sheet to the bottom. In particular, an adhesive bond between the bottom cover sheet and the corner tuck may be provided which is not continued into the region of the bottom flaps.

The draw-off capability of the bottom cover sheet may be assisted, furthermore, by a tear-open strip in the bottom cover sheet.

In a preferred embodiment, the incision at the bottom flap, said incision being provided as a tear-open aid, is limited to less than half of the length of the bottom flaps. In particular, it is expedient that the incision extends only over the region in which the two bottom flaps mutually overlap, so that the incision does not cause any impairment in the leaktightness of the cross bottom for transporting the product from the bag-filling station to the place of use.

The present invention is suitable particularly for bags which consist of easily tearable materials, such as, for example, bags made from kraft papers. In this case, the bags may also be of multi-ply design. However, the present invention can also be implemented on suitable plastic bags, particularly when the tear-open aid extends, if appropriate, over the entire length of the tearing lines. As well as the tear-open strips mentioned, perforation lines, in particular slit perforations, may also be considered as tear-open aids.

DESCRIPTION OF THE DRAWINGS

The invention will be explained in more detail below with reference to an exemplary embodiment illustrated in the drawings, in which.

DETAILED DESCRIPTION

Figure 1:
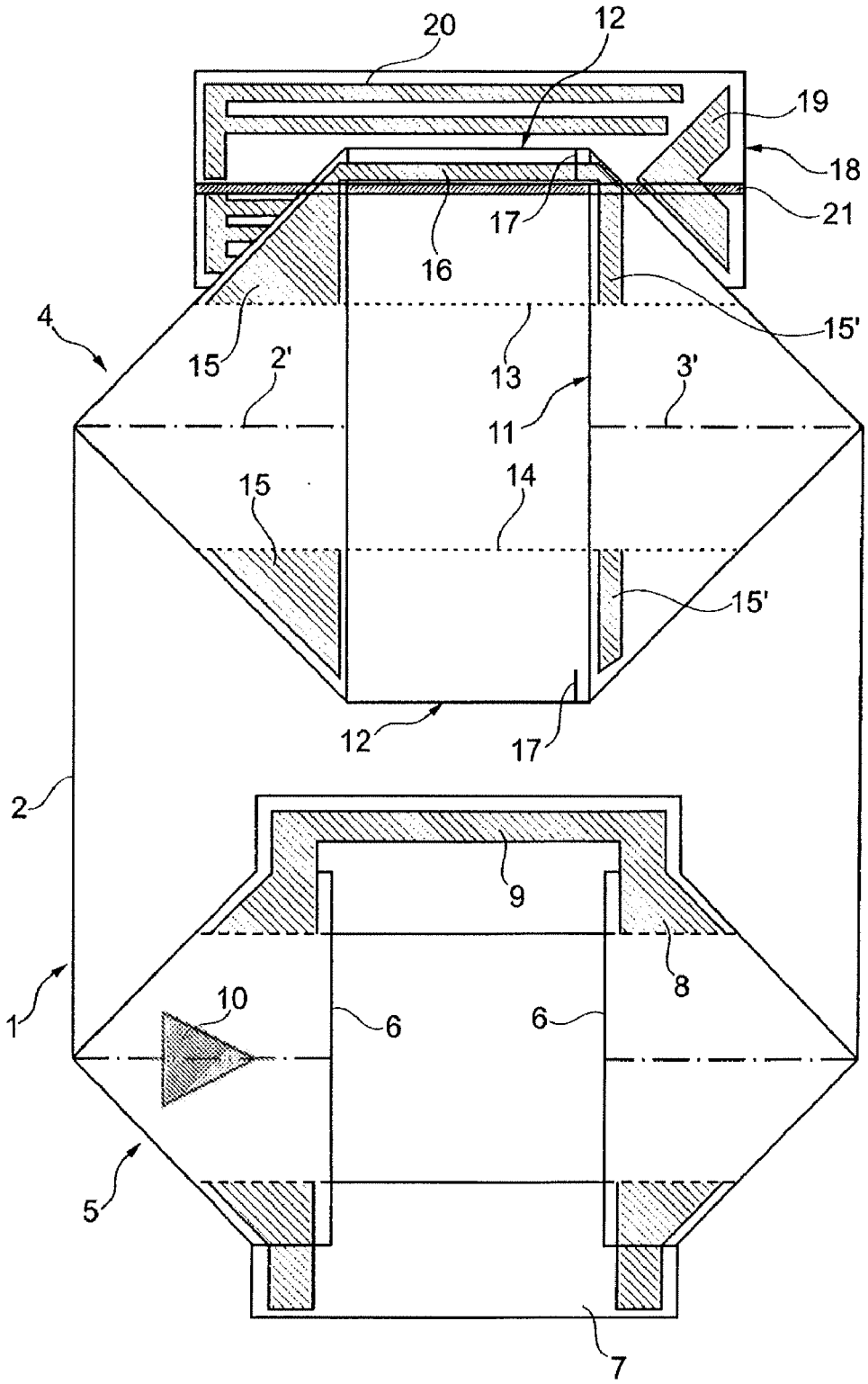
FIG. 1 shows a bag tube lying flat, with corner tucks and prescored bottom folding lines and with a bottom cover sheet.

FIG. 1 shows a tubular casing wall 1 of a bag, which casing wall is folded at two side folding lines 2, 3 in order to lay the plies of the casing wall 1 flat one on the other. The tubular casing wall 1 is formed from a material lying flat, by being folded round at the side folding lines 2, 3, and is connected, for example by means of a longitudinal adhesive bond, into the closed tube in an overlapping region. The longitudinal adhesive bond is not illustrated in the drawing.

FIG. 1 makes clear that the tube cut off from an endless material is provided at both ends with a cross bottom 4, 5. The lower cross bottom 5, illustrated in FIG. 1, consists of two mutually opposite corner tucks 6 and two mutually opposite bottom flaps 7 which thus, crosswise, form the material of the cross bottom 5. The bottom flaps 7 are provided on their insides with adhesive zones 8, 9, illustrated by hatching, of which the adhesive zones 8 cause connection to the corner tuck 6 and the adhesive zone 9 causes the connection of the bottom flaps 7 mutually overlapping after folding, to one another. Illustrated symbolically in FIG. 1, above one of the corner tucks 6, is a valve 10 which may be designed in one of the many known embodiments. The valve 10, which may consist, for example, of a tubularly folded insert sheet, is inserted into the bottom before the folding of the bottom flaps 7 and is thus connected firmly to the bottom. Via the valve 10, the filling of the bag by means of a filling connection piece (not illustrated) of a filling machine (not illustrated) takes place.

The cross bottom 4 formed at the other end of the casing wall 1 is designed according to the invention, such that an emptying of the bag can take place via said cross bottom. The cross bottom 4 is likewise formed by corner tucks 11 and bottom flaps 12. The bottom flaps 12 are angled to the plies of the cylindrical casing wall 1 by means of folding lines 13, 14. Corresponding folding lines 13, 14 are continued into the region of the corner tucks 11. Since, after the folding of the cylindrical casing wall 1, the corner tucks 11 have been formed, along the side folding lines 2, 3, into a tube lying flat, the side folding lines 2, 3 are continued in the corner tucks 11 as central folding lines 2', 3'. The triangularly designed corner tucks 11 extend, connected in one piece, into the region of the bottom flaps 12, so that the bottom flaps 12 acquire a double-walled design by virtue of the portions of the corner tucks 11 on the far side of the folding lines 13, 14.

It can be seen that the bottom flaps 12 are provided on their inside with adhesive surfaces 15, 16 by means of which, when the bottom flaps 12 are folded about the folding lines 13, 14, an adhesive connection of the bottom flaps 12 to the central portions of the corner tucks 11, on the one hand, and between the mutually overlapping regions of the bottom flaps 12, on the other hand, is made.

First, the bottom flap 12 (toward the top in FIG. 1) foldable about the folding line 14 is folded, with the result that gluing to the middle portions of the corner tucks 11 takes place via the adhesive surfaces 15. It can be seen that, in FIG. 1, for the right of the two corner tucks 11 an adhesive bond is provided only over a narrow strip 15' between the bottom flaps 12 and corner tuck 11.

After the bottom flap 12 has been folded about the folding line 14 and glued onto the tuck 11, the bottom flap 12 is folded about the folding line 13. By means of the adhesive surfaces 15, 15' that region of the tuck 11 which is not yet covered by the other bottom flap 12 and the overlapping region of the two bottom flaps 12 are glued to one another. The strip-shaped adhesive surface 16, which runs parallel to the folding lines 13, 14, serves for completing the gluing of the two bottom flaps 12 to one another.

Outside the right corner tuck 11, the two bottom flaps 12 have short incisions 17 which run perpendicularly with respect to their free edges and which therefore run parallel to the free edge of the adjacent corner tuck 11. The incisions 17 extend solely in the overlapping region of the two folded-round bottom flaps 12.

One of the two bottom flaps 12 is glued to a rectangular bottom cover sheet 18. In this embodiment, the bottom cover sheet 18 covers the entire bottom of the bag, after the latter has been shaped, after filling, into an essentially rectangular cross section, such as is illustrated in FIGS. 2 to 5.

The bottom cover sheet 18 has, on one of the short sides, a V-shaped adhesive surface 19, by means of which the bottom cover sheet 18 is glued to a middle region of the associated corner tuck 11. However, this adhesive bond 19 is at a marked distance from the adjacent bottom flap 12.

Moreover, the bottom cover sheet 18 is provided on its inside with adhesive surfaces 20 which extend as elongate strips to just short of the adhesive surface 19 and as a transversely running end-face connecting strip on the bottom cover sheet 18.

Furthermore, the bottom cover sheet 18 is provided with an elongate tear-open strip 21 which is arranged approximately centrally in the bottom cover sheet and which may extend over the entire length of the latter.

Figure 2:
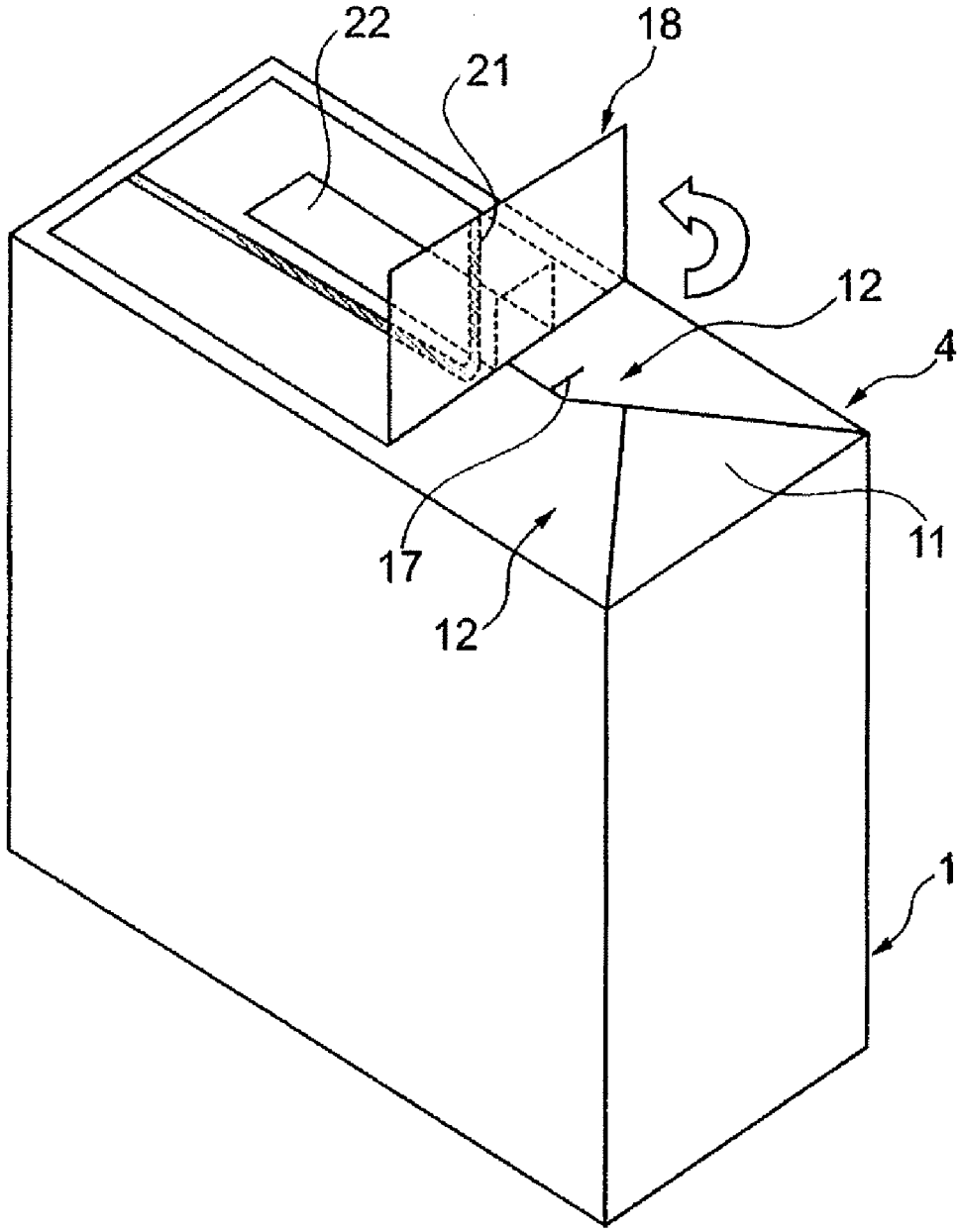
FIG. 2 shows a perspective illustration of a closed bottom with a partially drawn-off bottom cover sheet.

FIG. 2 shows the bag which is formed from the blank according to FIG. 1 and which has the cross bottom 4 on its top side.

The bottom cover sheet 18 has been drawn off by means of its tear-open strip 21 from the material of the corner tuck 11 and of the bottom flaps 12, so that the incision 17 of the upper bottom flap 12 is exposed. The tear-open strip 21 ensures that, in the region occupied by it, no (unwanted) gluing takes place between the bottom cover sheet 18 and bag bottom.

FIG. 2 reveals that, in the exemplary embodiment illustrated, the bottom cover sheet 18 is provided with a punched-free carrying strip 22.

Figure 3:
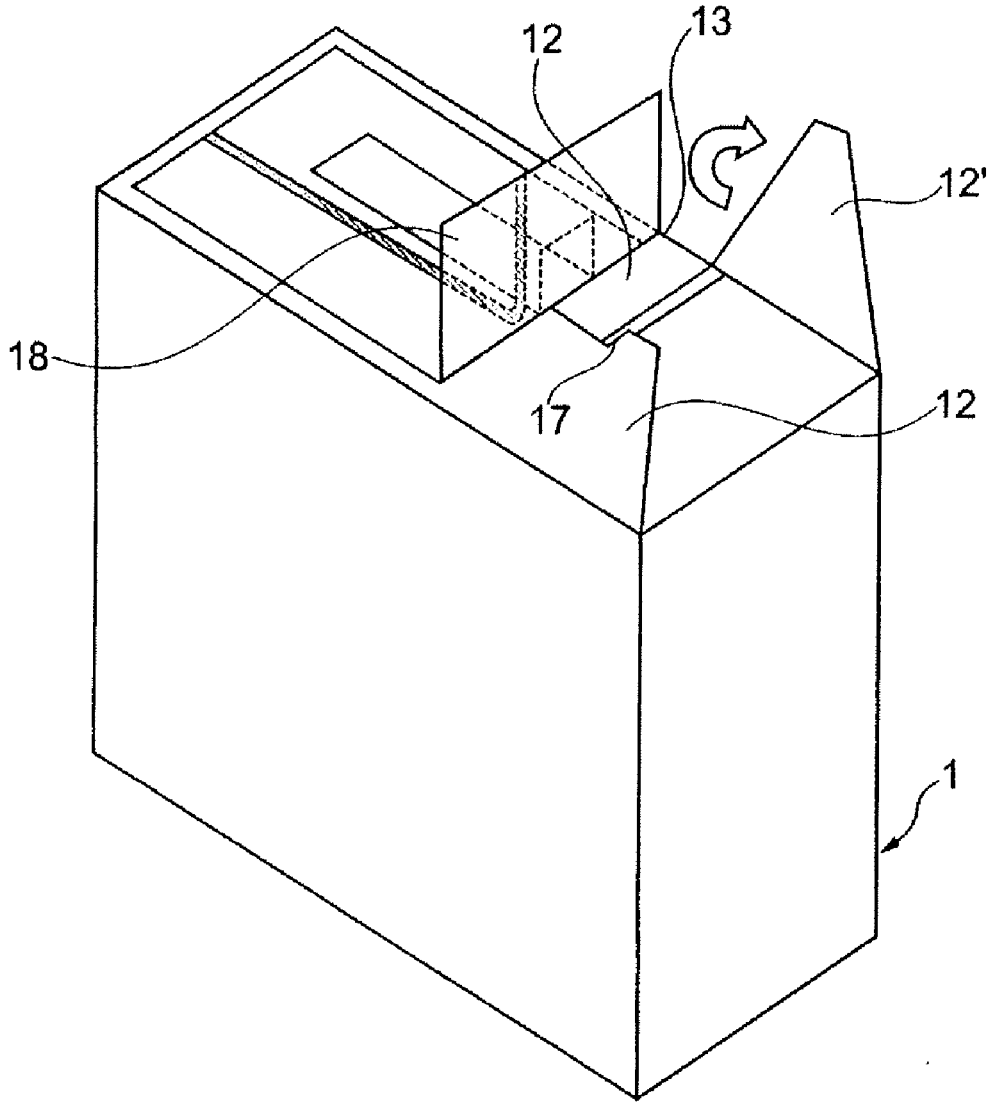
FIG. 3 shows the perspective illustration according to FIG. 2 with a first torn bottom flap.

The next step in opening the bag for emptying purposes is illustrated in FIG. 3. By the upper bottom flap 12 being torn at the incision 17 as far as the folding line 13 at which the bottom flap 12 is connected to large sidewalls of the cylindrical casing wall 1, a portion 12' of the bottom flap 12 can be bent upward about the folding line 13. The incision 17 of the lower bottom flap 12 is thereby exposed.

Figure 4:
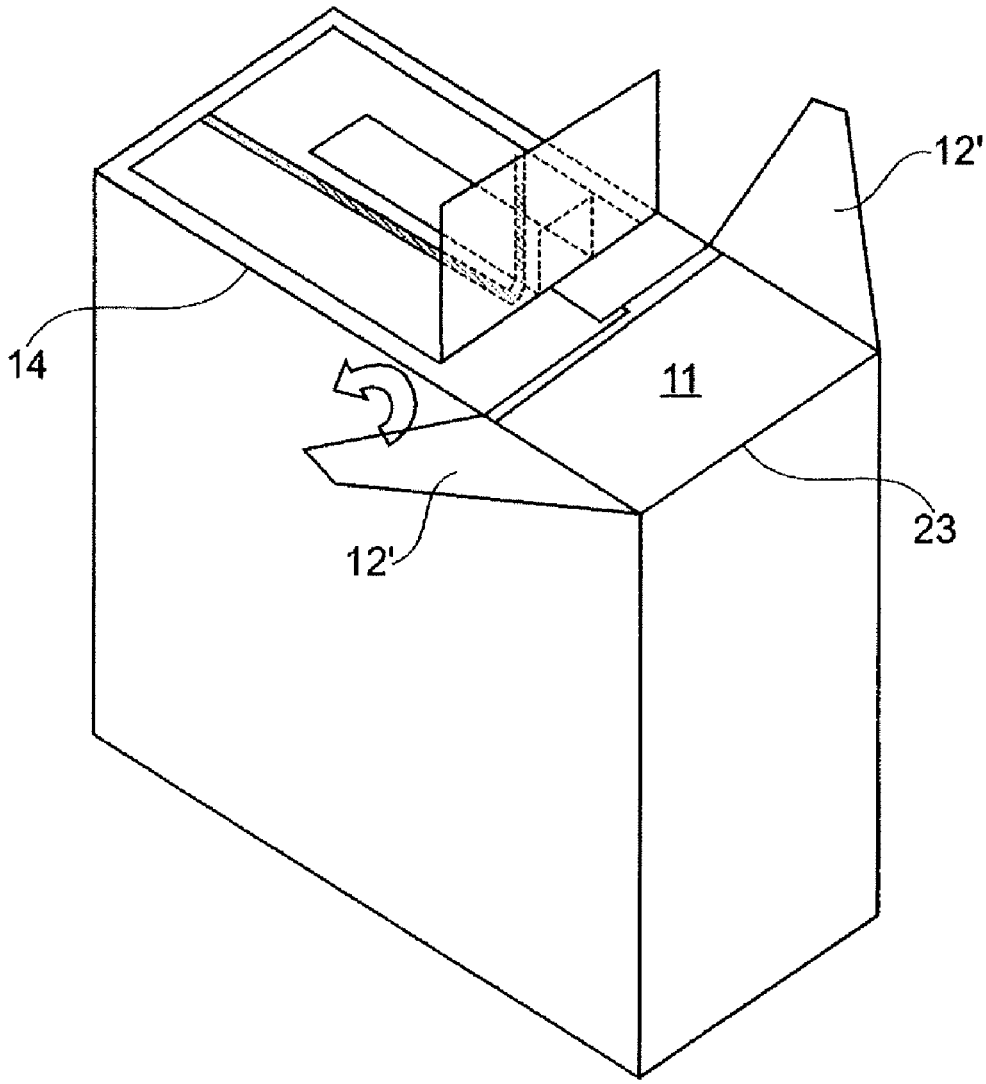
FIG. 4 shows the illustration according to FIG. 3 with a second bottom flap freed by tearing.

In the next step, which is illustrated in FIG. 4, the lower bottom flap is also torn open as far as the folding line 14 by means of the incision 17, with the result that a portion 12' of the bottom flap 12 can likewise be bent upward.

The upwardly bent parts 12' of the bottom flaps 12 are predominantly of two-ply design, since they are connected to parts of the corner tuck 11 via a fold.

Figure 5:
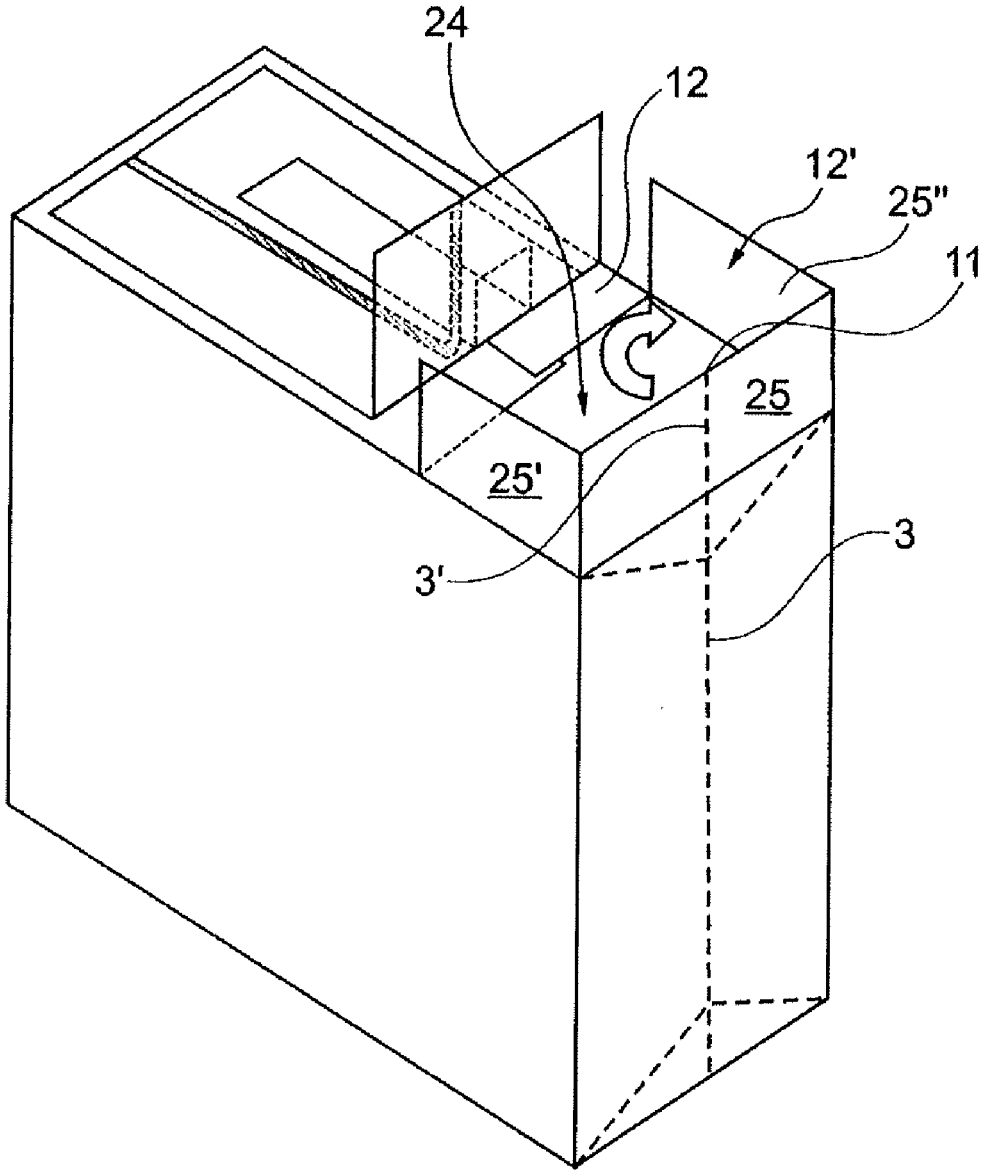
FIG. 5 shows a perspective illustration according to FIG. 4 in which the corner tuck is also bent up in order to form a pour-out channel.

The middle region of the corner tuck 11 can then be bent upward about a folding line 23, as illustrated in FIG. 5. By the material of the corner tuck 11 being folded up from the material of the part 12' of the bottom flap 12, a pour-out channel 24 is obtained which is delimited by three material portions 25, 25', 25". The material portions 25, 25' and 25" are delimited on the top side by smooth edges cut during the manufacture of the bag, so that a defined pour-out channel 24 is obtained. Since the material portion 25 is provided with a portion of the folding line 3, the pour-out channel 24 can easily be shaped into a triangular pour-out channel 24 in the form of V by means of a V-shaped fold along the folding line 3. This ensures that the product introduced into the bag can be poured out in a directed manner even where small pour-out quantities are concerned.

According to the invention, therefore, a defined pour-out channel 24 can be produced from the material of the cross bottom 4, said pour-out channel allowing a defined pouring of the product out of the bag without the risk of contamination. In particular, the handling of heavily contaminating or even toxic materials is thereby made considerably easier.

In the exemplary embodiment illustrated, the cross bottom 4 provided for forming the pour-out channel 24 is located on the opposite end of the cylindrical casing wall 1 to that where the cross bottom 5 provided with a valve 10 is formed. The forming according to the invention of the pour-out channel 24 may, of course, just as easily take place in the cross bottom 5 which is provided with a valve 10 for introducing the product into the bag. However, arranging a bottom cover sheet 18 with a carrying grip 22 on the bag end lying opposite the valve 10 has the advantage that, when the bag is being carried, the product weight lies on the valve 10 and, if appropriate additionally closes the latter. Nevertheless, even in a cross bottom 5 provided with a valve 10, an appropriate emptying orifice for forming a pour-out channel 24 can be provided.

The invention claimed is:

1. A method for emptying a bag which has at least one cross bottom which is covered by a bottom cover sheet and has an essentially rectangular shape and which is glued together out of corner tucks angled from narrow sidewalls via folding lines and out of bottom flaps angled from wide sidewalls via folding lines so that the bottom flaps mutually overlap each other at free ends of said bottom flaps and are glued to one another thereby forming an upper and a lower bottom flap within an overlap area, comprising steps of:

drawing off, starting from a narrow sidewall of said narrow sidewalls, the bottom cover sheet from the respective corner tuck and from parts of the bottom flaps which are adjoining; and tearing an upper bottom flap of the bottom flaps in the overlap area transversely to a free edge as far as the wide sidewall which is adjoining in order to separate a part;

tearing a lower bottom flap of the bottom flaps in the overlap area transversely to a free edge as far as the wide side wall which is adjoining in order to separate another part;

bending said separated part and said separated another part, respectively of said upper bottom flap and said lower bottom flap, together with a corner tuck by folding up about respective folding lines into a pour-out channel through which emptying of the bag contents takes place.

2. The method as claimed in claim 1, wherein the bottom cover sheet includes a tear-open strip which permits drawing off the bottom cover sheet.

3. The method as claimed in claim 1, wherein the bottom flaps include tear-open aids, and wherein said tearing steps are performed using said tear-open aids.

4. The method as claimed in claim 1, wherein the pour-out channel is shaped in the form of a V by means of a middle fold of the narrow sidewall.

5. A bag, comprising;

a closed tube formed by at least one material ply and being shaped into an essentially rectangular cross section with narrow sidewalls and wide sidewalls;

a cross bottom at at least one end of said closed tube, the cross bottom being glued together with corner tucks angled from the narrow sidewalls and with bottom flaps angled from the wide sidewalls, wherein the bottom flaps include upper and lower bottom flaps which mutually overlap each other at their free ends in an overlap area, and wherein said upper and lower bottom flaps are glued to one another; and a bottom cover sheet covering the cross bottom, wherein the bottom cover sheet is capable of being drawn off from the cross bottom starting from a narrow sidewall of the narrow sidewalls over at least a partial region exceeding the respective corner tucks, wherein at least the upper bottom flap in the overlap area has at least one tear-open aid lying beyond the respective corner tuck and directed transversely to a free edge of the upper bottom flap so that a separated part of the upper bottom flap and a corresponding separated part of the lower bottom flap, and an outwardly drawn corner tuck together form a pour-out channel.

6. The bag as claimed in claim 5, further comprising an adhesive bond which ensures the draw-off capability of the bottom cover sheet.

7. The bag as claimed in claim 5, further comprising a tear-open strip which assists in the draw-off capability of the bottom cover sheet.

8. The bag as claimed in claim 5, wherein the tear-open aid is formed by an incision directed transversely with respect to the free edge of the upper bottom flap.

9. The bag as claimed in claim 8, wherein the incision extends over less than half the length of the upper bottom flap.

10. The bag as claimed in claim 9, wherein the incision extends only over the overlap area.

11. The bag as claimed in claim 5 wherein both the upper bottom flap and the lower bottom flap have said at least one tear open aid.

* * * * *